United States Patent [19]

Lübbing

[11] 4,429,674

[45] Feb. 7, 1984

[54] MULTICYLINDER INTERNAL COMBUSTION ENGINE

[75] Inventor: Bernd-Eric Lübbing, Winterbach, Fed. Rep. of Germany

[73] Assignee: Daimler-Benz Aktiengesellschaft, Fed. Rep. of Germany

[21] Appl. No.: 323,483

[22] Filed: Nov. 20, 1981

Related U.S. Application Data

[63] Continuation of Ser. No. 46,493, Jun. 7, 1979, abandoned.

[30] Foreign Application Priority Data

Jun. 14, 1978 [DE] Fed. Rep. of Germany ..... 2826025

[51] Int. Cl.[3] ..... F02B 3/00

[52] U.S. Cl. ..... 123/531; 123/585; 123/533; 239/575; 239/533.2; 261/76; 261/DIG. 39

[58] Field of Search ..... 261/76, 78 R, DIG. 39; 239/575, 432, 533.2, 533.3, 533.4, 533.5, 533.6–533.12; 123/527, 531, 511, 590, 593, 585, 533, 532, 534

[56] References Cited

U.S. PATENT DOCUMENTS

| | | | |
|---|---|---|---|
| 1,279,775 | 9/1918 | Sprado | 123/531 |
| 2,963,282 | 12/1960 | Jacobitz | 261/76 |
| 2,983,491 | 5/1961 | Powell | 261/76 |
| 3,632,043 | 1/1972 | Kirschmann | 239/575 |
| 3,993,892 | 3/1976 | Brinkman | 123/139 E |
| 4,088,104 | 5/1978 | Ibbott | 261/78 R |
| 4,157,084 | 6/1979 | Wallis | 123/139 AW |
| 4,162,281 | 7/1979 | Ingraham | 123/32 E |
| 4,325,341 | 4/1982 | Yamauchi | 261/DIG. 39 |
| 4,361,126 | 11/1982 | Knapp | 123/585 |

*Primary Examiner*—Charles J. Myhre
*Assistant Examiner*—Carl S. Miller
*Attorney, Agent, or Firm*—Craig & Burns

[57] ABSTRACT

A multicylinder internal combustion engine, especially a self-igniting internal combustion engine, with supply ducts leading to the cylinders which supply ducts emanate from a common fuel supply chamber with the ducts being supplied with a fuel-gas mixture. The fuel-gas mixture is present in a mist form in the supply chamber with the fuel, with a substantially identical droplet size, exhibiting a droplet diameter at which a flow characteristic is obtained for the droplets in the ducts leading to the cylinders which is respectively at least approximately identical to the flow characteristic of the gas. The fuel is fed to the common supply chamber continuously by way of an injection device with the premixed fuel-gas mixture, which is at a pressure elevated with respect to the pressure level in the supply chamber, exiting from the injection device at a speed of sound with atomization of its proportion of fuel, on account of a pressure jump at a cross section of the discharge orifice of the injection device.

1 Claim, 2 Drawing Figures

MULTICYLINDER INTERNAL COMBUSTION ENGINE

Figure 1:
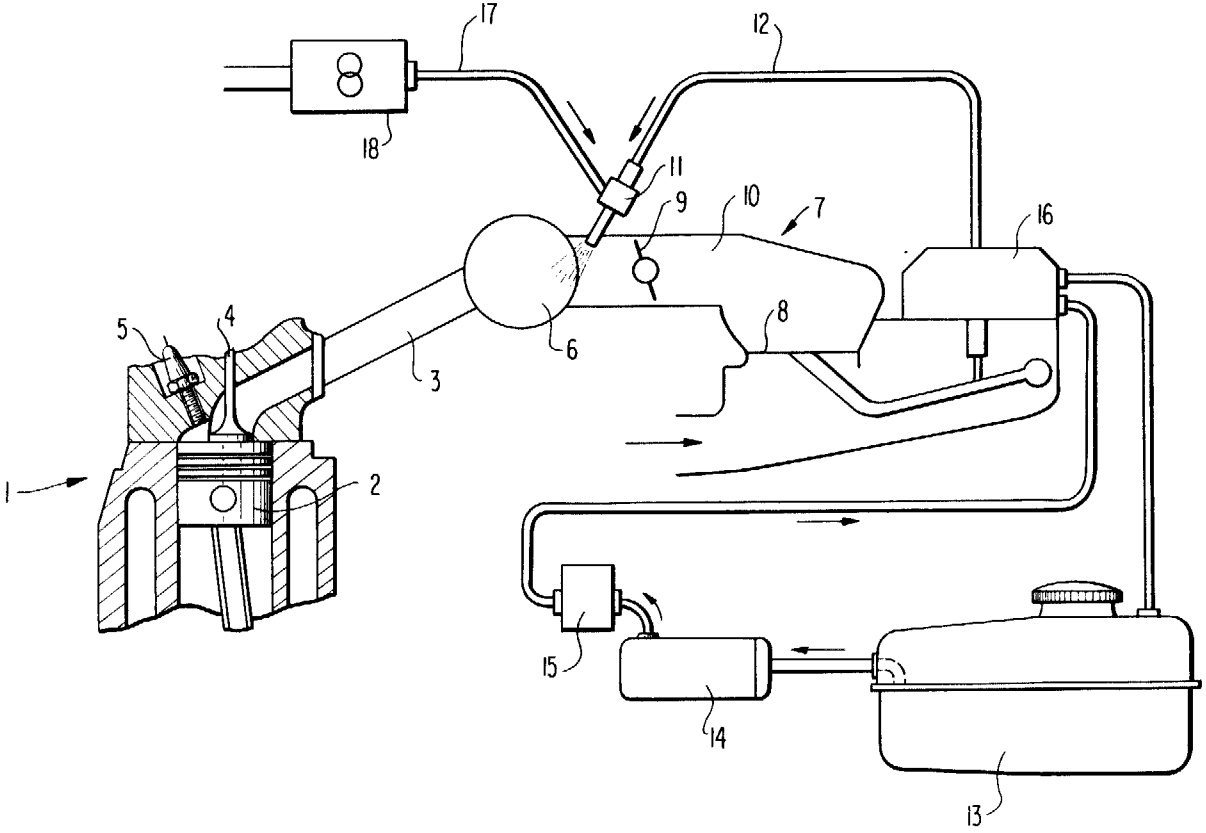

This is a continuation of application Ser. No. 046,493, filed June 7, 1979, now abandoned.

The present invention relates to a multicylinder internal combustion engine and, more particularly, to a self-igniting internal combustion engine which includes fuel supply ducts or conduits leading to the respective cylinders of the engine which ducts or conduits emanate from a common supply chamber which supplies a fuel-gas mixture.

In proposed internal combustion engines of the aforementioned type, carburetors are customarily employed to supply a fuel-gas mixture. However, the fuel-gas mixture preparation conditions encountered, especially in a cold start and intermittent operation as well as in idling and in a stationary lower partial load range, are so poor that, in spite of the fact that the supply ducts emanate from one and the same fuel supply chamber, the individual cylinders receive a fuel supply wherein the fuel proportions of the respective fuel-gas mixture, especially a fuel-air mixture, are different. This is due essentially to the fact that substantial proportions of the fuel adhere to the walls of the carburetor and/or supply ducts and thus, insofar independent from the air distribution, flow uncontrollably to the individual cylinders.

The aim underlying the present invention essentially resides in providing a fuel supply and/or an internal combustion engine of the aforementioned type having a fuel supply which insures the maintenance of the same fuel-air ratios in the individual cylinders of the engine independently of whether each of the cylinders has the same feed rate or filling degree.

In accordance with advantageous features of the present invention, the fuel-gas mixture is present in a mist form in the common fuel supply chamber with the fuel having an essentially identical droplet size such that a diameter of the droplets is obtained so as to result in a flow characteristic in the supply ducts or conduits leading to the cylinders which is at least respectively approximately the same as the flow characteristic of the gas.

According to the present invention, the fuel may be fed to the common fuel supply chamber continuously by way of an injection means and a premixed fuel-gas mixture, at an elevated pressure as compared to a pressure level ambient in the common fuel supply chamber, exits from the injection means at the speed of sound, with an atomization of its fuel proportion due to a pressure jump at a cross-section of an orifice of the injection means.

By virtue of the above-noted features of the present invention, any adhesions of the fuel to the walls of the common fuel supply chamber and/or supply ducts are, for all practical purposes, excluded and, due to this fact, an identical fuel-air ratio is obtained for all cylinders in spite of the fact that the feed rate, under practical operating conditions of the internal combustion engine, is unavoidably different for the various cylinders. Thus, the present invention provides the possibility of supplying all cylinders of the internal combustion engine with a given desired fuel-air ratio thereby creating correspondingly improved conditions for emission control.

Furthermore, by employing an injection means such as proposed by the present invention, it is not only possible to insure the obtaining of the desired very small droplet size during a production of the fuel-gas mixture, but it is also possible to provide such a great uniformity among the droplets that droplet coagulations are largely avoided since, as is known, droplet coagulation is promoted by nonuniform droplet diameters.

Additionally, the uniform very small droplet size is insured by the injection means of the present invention by virtue of the fact that the pressure energy of the gases may be directly utilized for atomization since, due to an intensive premixing of the fuel with the gas, the characteristic speed of sound dependent on the volume proportion of the gas can be attained in an orifice region of the injection means and, consequently, there is no substantial pressure drop due to the increase in velocity of the mixture so that the ensuing very pronounced pressure jump results in obtaining a very good and uniform atomization.

In addition to preparing a fuel-air mixture for an internal combustion engine by carburetors, it has also been proposed to inject the fuel into the individual supply ducts leading to the cylinders. In such arrangements, injection devices are used wherein the fuel, upon exiting from the injection device, comes into contact with the gas, especially air, and is thus atomized due to sheer forces exerted by the gas. First of all, in this process, the droplet spectrum attained is not uniform so that the mixture formation as such could not satisfy the posed requirements and, for this reason, the injection of fuel is additionally directed toward vaporizing zones which may be formed by valve disks thereby involving the need for arranging the injection nozzle in very close proximity to the respective cylinder inlets. Consequently, with such proposed arrangements, employed in conjunction with the continuous injection and the discontinuous air flow, especially the air intake flow, a disadvantage resides in the fact that outside of the actual inlet phase, such a high droplet density may occur that coagulation of the drops and/or wall adhesions are promoted thereby resulting in supply conditions to the respective cylinders of the internal combustion engine which are non-uniform, especially in the range of load changes, with the supply conditions being additionally adversely affected by irregularities occurring because a completely identical feed rate for the individual cylinders of the internal combustion engine is unattainable anyway under practical operating conditions.

In accordance with further advantageous features of the present invention, the injection means is constructed in the form of an injection nozzle which includes a mixing chamber and a discharge orifice having a cross section which is adapted to be blocked by a valve means which selectively opens in dependence upon the pressure in the mixing chamber so as to effect a sudden and safe control of the mixing chamber by a blocking action.

Preferably, according to the present invention, the valve means is constructed as a spring-loaded shut-off valve which is biased or urged by the force of the spring into a closed position.

Furthermore, the mixing chamber of the present invention is provided with a porous insert element which functions as a fuel filter for the fuel mixture supplied to the respective cylinders of the internal combustion engine.

Accordingly, it is an object of the present invention to provide a fuel supply arrangement for an internal combustion engine which avoids, by simple means, shortcomings and disadvantages encountered in the prior art.

Another object of the present invention resides in providing a fuel supply arrangement for an internal combustion engine, especially a self-igniting internal combustion engine, which insures the supplying of the same fuel-air ratio to the individual cylinders regardless of the feed rate to such cylinders.

A further object of the present invention resides in providing a fuel supply arrangement for an internal combustion engine by which the fuel is supplied in very small and uniformly sized droplets.

Yet another object of the present invention resides in providing an internal combustion engine, especially a self-igniting internal combustion engine, which includes a fuel supply arrangement enabling the internal combustion engine to function reliably under all operating load conditions.

A still further object of the present invention resides in providing a fuel supply arrangement for an internal combustion engine which is simple in construction and therefore relatively inexpensive to manufacture.

Figure 2:
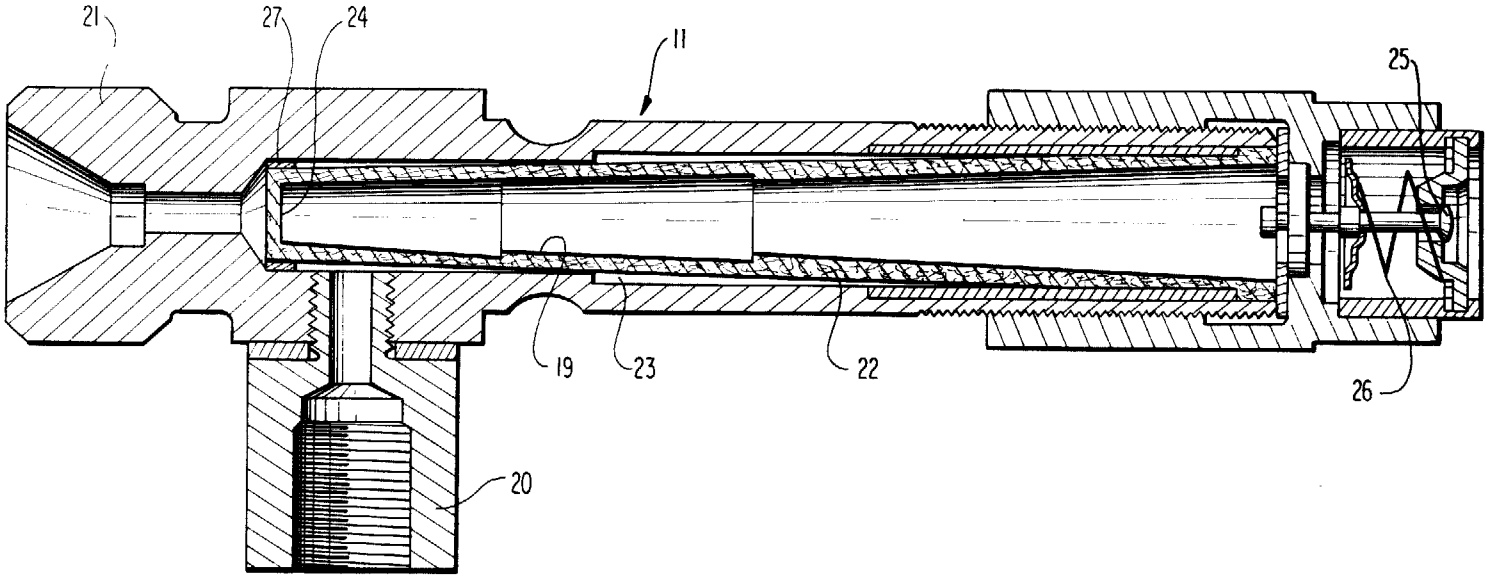

These and other objects, features, and advantages of the present invention will become more apparent from the following description when taken in connection with the accompanying drawings which show, for the purposes of illustration only, one embodiment in accordance with the present invention, and wherein:

FIG. 1 is a schematic, partial cross-sectional view of an internal combustion engine having a fuel supply arrangement in accordance with the present invention; and FIG. 2 is an axial cross-sectional view of an injection nozzle of the fuel supply arrangement in accordance with the present invention.

Referring now to the drawings wherein like reference numerals are used in both views to designate like parts and, more particularly, to FIG. 1, according to this figure, an internal combustion engine 1 includes a plurality of cylinders, only one of which is shown in the drawing for the sake of clarity, with a piston 2 being arranged in the respective cylinders and a suppy duct, serving as an intake duct, terminating at a side of the cylinder head. An inlet valve 4, associated with an outlet side of the supply duct 3, controls the communication between the supply duct 3 and the combustion spaces of the respective cylinders. A spark plug 5 serves as an ignition source for the fuel mixture supplied to the respective combustion spaces. The supply duct 3 emanates from a fuel supply chamber 6 which is common to all cylinders of the internal combustion engine 1 and may be constituted by, for example, a manifold. It is possible, in accordance with the present invention, with internal combustion engines having several cylinder rows, to associate an individual supply chamber 6 with each of the respective cylinder rows.

As shown in FIG. 1, an intake system, generally designated by the reference numeral 7, is connected to the common fuel supply chamber 6 with a throttle valve 9, arranged in a conventional manner in an intake duct 10 of the intake system 7, being provided downstream of a choke valve 8 which is constructed as a flow meter.

An injection nozzle 11, forming an injection means, is disposed in a transition between the intake duct 10 and the common fuel supply chamber 6 and/or in a zone between the throttle valve 9 and the common fuel supply chamber 6 with the injection nozzle 11 being supplied with fuel by way of a suitable conduit 12. Fuel is fed from a fuel tank 13 by way of a low-pressure pump 14, a filter 15, and a fuel flow meter 16 which controls the flow of fuel or the fuel feed rate in dependence upon a position of the choke valve 8. A backflow or return line extends from the flow meter back to the fuel tank 13.

An air conduit 17 has one end thereof terminating at the injection nozzle 11 with the other end thereof emanating from an air compressor 18 which, in the illustrated embodiment, is adapted to draw in fresh air. Air may also be branched off from the intake system 7 in a zone downstream of the choke valve 8 in a manner not illustrated in the drawings.

As shown in FIG. 2, in the injection nozzle 11, fuel and air are introduced under pressure and are intermixed so that the air and fuel form a mixture in the injection nozzle 11, in which mixture the air is practically embedded in the fuel in a bubble form. This fuel-air mixture under pressure can have a characteristic speed of sound which, in dependence upon the proportion of the gas volume, is substantially below the speed of sound of the air, here serving as the gas, and also below the speed of sound of the fuel (a quasi homogeneous mixing being the prerequisite). The fuel-air mixture is injected with the speed of sound by way of a discharge orifice. The proporation of the pressure not converted into speed, due to the fact that the characteristic speed of sound has been reached, effects an atomization of the fuel across the occluded gas whereby an especially fine and uniform atomization is attained.

The injection means in FIG. 2, constructed as an injection nozzle 11, includes a mixing chamber 19 which communicates with a connection 21 for the fuel supply line 12 and a connection 20 for the compressed air supply line 17. A porous insert 22 is arranged in the mixing chamber 19 and, in the illustrated embodiment, the porous insert extends substantially over the length of the elongated mixing chamber 19 and is clamped in between the two end faces of the chamber with an annular space 23 remaining between the insert 22 and the mixing chamber 19.

In FIG. 2, the insert 22, constituted by, for example, a porous sintered element, forms a filter with fuel entering the filter by way of the end face 24 while air is urged into the annular space 23 and from the annular space 23 diffuses by way of the sintered element serving as the insert 22 into the fuel and mixes therewith. This fuel-air mixture exerts a pressure corresponding to the supply pressure exerted on a shut-off valve 25 provided on the discharge orifice side of the injection nozzle 11. The valve 25 is adapted to open in an injection direction and is biased or normally urged by a spring 26 in a direction toward a closing position.

The mixing chamber insert 22 may also be inserted in the mixing chamber 19 so that the fuel and air together act on the insert 22 from the outside thereof so that the fuel and air together are forced into the inner space of the insert 22 and are thus mixed together. In such an arrangement, it would then be possible to dispense with the provision of a sealing means 27 at the end face 24 of the insert 22.

While I have shown and described only one embodiment in accordance with the present invention, it is understood that the same is not limited thereto, but is susceptible of numerous changes and modifications as are apparent to one having ordinary skill in the art, and I therefore do not wish to be limited to the details shown and described herein, but intend to cover all such modifications as are encompassed by the scope of the appended claims.

I claim:

1. A fuel supply arrangement for an internal combustion engine, the fuel supply arrangement including an injection means for supplying a premixed fuel-gas mixture so that the fuel is in the form of a mist with droplets of a substantially identical droplet size each having a diameter at which a flow characteristic is obtained which is the same as a flow characteristic of the gas of the fuel-gas mixture, the injection means includes a discharge orifice, and is constructed so that the fuel-gas mixture is discharged from the discharge orifice substantially at the speed of sound, and in that the injection means includes an injection nozzle, a fuel-gas mixing chamber means comprising a longitudinal bore hole in the injection nozzle, a valve means for selectively opening and closing the discharge orifice in dependence upon a pressure in the mixing chamber means, an approximately cylindrically shaped insert means, of porous material and having a hollow interior, is arranged in the mixing chamber means for filtering all of the air reaching the nozzle and all of the fuel, and disposed with a hollow space between its outer circumference and the wall of the longitudinal bore hole, and comprising closure means at one cylindrical end of the insert means, means contiguous to the closure means to seal the insert means radially with respect to said longitudinal bore hole for isolating said hollow space from the closure means, means for introducing fuel to said injection means toward an exterior of said closure means of said insert means, means for introducing compressed air to the hollow space, and the hollow interior of said insert means being developed conically to present an enlarged aperture to said valve means.

* * * * *